US005833107A

United States Patent [19]

Terranova et al.

[11] Patent Number: 5,833,107

[45] Date of Patent: Nov. 10, 1998

[54] APPARATUS FOR DRAWING, A WEB THROUGH A SYNCHRONIZATION SECTION OF A BAG MAKING MACHINE

[75] Inventors: Peter Terranova, Howard Beach; John Simonetti, Deer Park, both of N.Y.

[73] Assignee: Ro-An Industries Corporation, Middle Village, N.Y.

[21] Appl. No.: 811,151

[22] Filed: Mar. 4, 1997

[51] Int. Cl.[6] ..... B65H 23/18; B65H 20/24; B65H 39/00; B31B 1/64

[52] U.S. Cl. ..... 226/31; 226/42; 226/111; 270/52.08; 493/11; 493/193; 493/196

[58] Field of Search ..... 226/31, 36, 42, 226/44, 111, 115, 185; 493/193–197, 11, 12, 29; 270/52.07, 52.08

[56] References Cited

U.S. PATENT DOCUMENTS

| | | | |
|---|---|---|---|
| 3,119,537 | 1/1964 | Smits | 226/111 |
| 3,539,085 | 11/1970 | Anderson | 226/31 X |
| 3,645,430 | 2/1972 | Lagain | 226/111 X |
| 3,734,368 | 5/1973 | Kudelski | 226/111 X |
| 4,216,705 | 8/1980 | Achelpohl et al. | 493/194 X |
| 4,848,630 | 7/1989 | Niestrath et al. | 226/115 X |
| 5,002,522 | 3/1991 | Feustel | 493/194 X |
| 5,086,964 | 2/1992 | Blaser . | |
| 5,094,656 | 3/1992 | Hatchell et al. . | |
| 5,104,104 | 4/1992 | Mol | 270/52.08 |
| 5,230,688 | 7/1993 | Hatchell et al. | 493/193 |
| 5,297,712 | 3/1994 | Kobayashi et al. | 226/36 X |

*Primary Examiner*—Michael Mansen
*Attorney, Agent, or Firm*—Steinberg & Raskin, P.C.

[57] ABSTRACT

A split bag making machine includes a first primary split draw roller and a second primary split draw roller, each having first and second web contacting sections which are independently rotatable, the first section of the first primary split draw roller being in rolling engagement with the first section of the second primary split draw roller at a first nip, the second section of the first primary split draw roller being in rolling engagement with the second section of the second primary split draw roller at a second nip. A first servo motor is coupled to the first web contacting section of the first primary split draw roller, and a second servo motor is coupled to the second web contacting section of the first primary split draw roller. The respective rotational speeds of the first and second servo motors are controlled by a controller. The split bag making machine also includes a secondary split draw roller positioned upstream of the primary split draw rollers, the secondary split draw roller having a first web contacting section corresponding to the first web contacting sections of the primary split draw rollers and having a second web contacting section corresponding to the second web contacting sections of the primary split draw rollers. The webs are driven by the secondary split draw roller at the upstream end of the synchronization section, and driven by the primary split draw rollers at the downstream end of the synchronization section.

35 Claims, 11 Drawing Sheets

10
12
14
OPTICAL SCANNER
16
18
19
20.11
20.12
20
24
30
32
48
49
50
CONTROLLER

CONTROLLER
OPTICAL SCANNER
10
12
14
15
16
18
19
20
20.1
24
30
32
48
49
50

APPARATUS FOR DRAWING, A WEB THROUGH A SYNCHRONIZATION SECTION OF A BAG MAKING MACHINE

FIELD OF THE INVENTION

The present invention relates to the field of bag making machines.

BACKGROUND OF THE INVENTION

Split bag making machines typically include a pair of plastic webs which travel side-by-side through a compensator section, a synchronizing section, a hot knife section, a delivery section, and a stacking section. As the webs exit the compensator section, they are wound around a split idler roller and then travel across the synchronizing section and into a nip formed between the upper and lower split draw rollers. The upper and lower split draw rollers each include independently rotatable inner bag (IB) sections and outer bag (OB) sections. Each section of the lower split draw roller is driven by a respective servo motor.

U.S. Pat. No. 5,094,656 purports to disclose a single web bag making machine which includes an antibounce means (illustrated as a roller) driven by a lower draw roll via a belt. The lower draw roll is driven by a servo motor.

SUMMARY OF THE INVENTION

Prior art twin bag making machines have encountered difficulties in operating effectively at high speeds. For example, as web speed increases, the webs on a twin bag making machine tend to oscillate axially across their respective lower draw rollers. This oscillation is caused by a number of factors. For example, since the webs are continually accelerating and then stopping for hole punching, sealing, and cutting, the web is continually stretched and then relieved, causing oscillation of the web across the width of the rollers. In addition, because twin bag making machines are wider than single bag making machines, the split rollers in twin bag making machines are wider than the solid rollers of single bag making machines. This increased width causes the split rollers of twin bag making machines to flex or bow under the tension of the webs. This problem is exacerbated by the fact that, since the bag width and tension of one web may be different than the bag width and tension of the other web, the load applied to one side of the split roller will be different than the load applied to the other side of the split roller. As a result, the problem of web oscillation is much greater in split bag making machines than in single bag making machines. Web oscillation is a significant problem because, in order to maintain consistency in hole punch operation, the hole punch equipment must be reset each time the web moves.

Moreover, as the web speed increases in high speed operation, the increased tension on the web will cause a decrease in web width. This can be extremely problematic since uniform web width is important for accurate punching, cutting, and sealing operations. In addition, an increase in web speed causes an increase in web bounce in the synchronizing section of the machine. To counteract this bounce, it is known to add more spring tension to the compensator arms of the compensator section. This solution, however, disadvantageously results in an increased load to all the drive components.

The above-referenced problems with prior art split bag making machines can be alleviated in accordance with the present invention. One of the causes of the above-referenced problems is that the tension in the webs is not uniform. Specifically, since the web is made of plastic, non-uniform tension will distort the shape of the web. In conventional split bag making machines, the webs are fed through the compensator section, around a split idler roller, across the synchronizing section, and into the nip formed between the upper and lower split draw rollers. Therefore, the web is being pulled as dead weight across the synchronizing section from the compensator section, thereby contributing to non-uniform web tension and web oscillation.

In accordance with the present invention, a split bag making machine includes a first primary split draw roller and a second primary split draw roller, each having first and second web contacting sections which are independently rotatable, the first section of the first primary split draw roller being in rolling engagement with the first section of the second primary split draw roller at a first nip, the second section of the first primary split draw roller being in rolling engagement with the second section of the second primary split draw roller at a second nip. The first section could, for example, correspond to the IB side of the web, and the second section could correspond to the OB side of the web, or vice versa. A first servo motor is coupled to the first web contacting section of the first primary split draw roller, and a second servo motor is coupled to the second web contacting section of the first primary split draw roller. The respective rotational speeds of the first and second servo motors are controlled by a controller. The split bag making machine also includes a secondary split draw roller positioned upstream of the primary split draw rollers, the secondary split draw roller having a first web contacting section corresponding to the first web contacting sections of the primary split draw rollers and having a second web contacting section corresponding to the second web contacting sections of the primary split draw rollers. Therefore, in accordance with the present invention, the webs are driven by the secondary split draw roller at the upstream end of the synchronization section, and driven by the primary split draw rollers at the downstream end of the synchronization section.

In accordance with a first embodiment of the present invention, the first web contacting section of the secondary split draw roller is coupled to the first web contacting section of the first primary split draw roller via a transmission element, (e.g., a chain or belt) such that the rotational speed of the first web contacting section of the secondary split draw roller is equal to the rotational speed of the first web contacting sections of the first and second primary split draw rollers. The second web contacting section of the secondary split draw roller is coupled to the second web contacting section of the first primary split draw roller in the same manner.

With this construction, the webs are driven at the same surface speed at both ends of the synchronizing section, maintaining uniform web tension in the synchronizing section despite the changes in web speed which result both from the acceleration of the web during the active cycle of the draw rollers, and from changes in the operating speed of the machine (i.e., bags/min.). As a result, web oscillation is significantly reduced. Moreover, the web width in the synchronization section will remain essentially constant regardless of web speed. As discussed above, maintaining a uniform web width in the synchronizing section is important because the timing and positioning of the punching, cutting, and sealing operations are predicated on the expected web width. In addition, since the secondary split draw rollers are driven by the primary split draw rollers, when the primary split draw rollers are accelerated by their respective servo motors, the acceleration of the secondary split draw rollers is slightly retarded, thereby preventing slack from developing in the webs.

In accordance with another aspect of this embodiment of the present invention, first and second secondary split draw rollers are provided, each having first and second web contacting sections which are independently rotatable, the first section of the first secondary split draw roller being in rolling engagement with the first section of the second secondary split draw roller at a third nip, the second section of the first secondary split draw roller being in rolling engagement with the second section of the second secondary split draw roller at a fourth nip. With this construction, additional control over the webs is provided by the nips formed between the first and second secondary split draw rollers.

In accordance with a second embodiment of the present invention, the first web contacting portion of the secondary split draw roller is coupled to a third servo motor, and the second web contacting portion of the secondary split draw roller is coupled to a fourth servo motor. The first, second, third, and fourth servo motors are coupled to the controller, and are independently controllable therefrom. With this construction, it is possible to selectively advance or retard the secondary split draw rollers relative to the primary split draw rollers. For example, if a machine operator observes that there is too little tension on the IB web (e.g., because the web is oscillating), the operator can cause the controller to reduce the speed of the servo motor which is coupled to the IB side of the secondary split draw roller in order to increase the tension and eliminate the oscillation of the web. Similarly, if the operator observes that there is too much tension on a web, the speed of the respective servo motor can be increased.

In accordance with a third embodiment of the present invention, the second embodiment further includes sensors located in the synchronization section for detecting axial oscillation of the webs. The sensors, which are coupled to the controller, detect the location of the web and transmit information indicative of that location to the controller. If web oscillation is detected, the controller will adjust the relative speeds of the primary and secondary split draw rollers until the web oscillation is eliminated. Preferably, the controller increases the speed of the secondary split draw rollers as a function of a desired web position and an actual web position in order to increase tension in the web and eliminate web oscillation.

In accordance with a fourth embodiment of the present invention, the second embodiment further includes sensors located in the synchronization section for measuring web tension. The sensors, which are coupled to the controller, measure the tension of the web and transmit information indicative of that tension to the controller. If the measured web tension is outside of a predetermined desired value or range, the controller will adjust the relative speeds of the primary and secondary split draw rollers until the web tension is within the desired value or desired range.

It should be noted that the second, third, and fourth embodiments of the present invention can also be applied to a single bag making machine, carrying a single web, and having a first primary solid draw roller and a secondary solid draw roller coupled to a respective first and second servo motors.

DETAILED DESCRIPTION OF THE INVENTION

Figure 1:
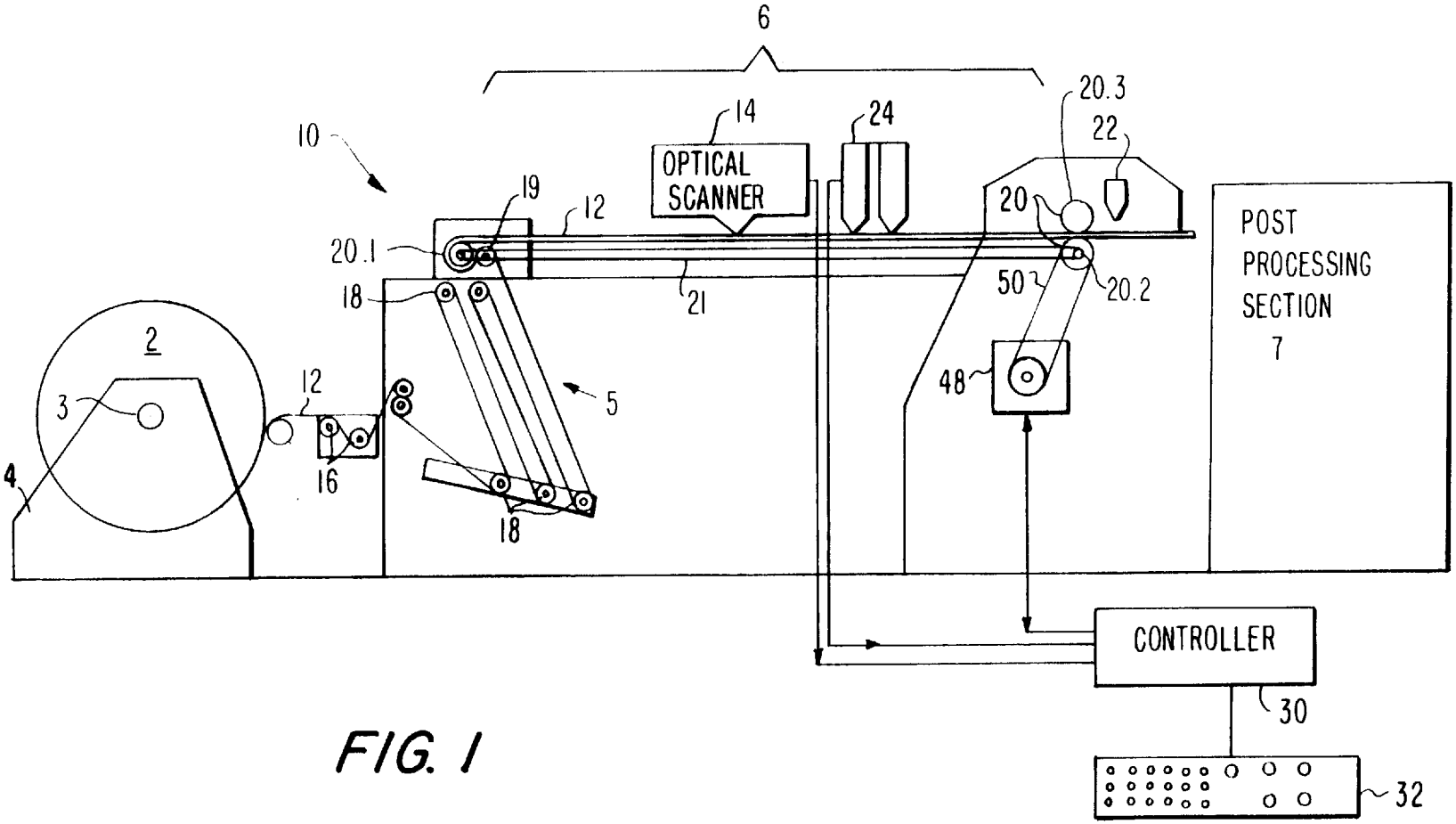
FIG. 1 shows a split bag making machine in accordance with a first embodiment of the present invention.

FIG. 1 shows a split bag making machine 10 in accordance with an illustrative embodiment of the present invention. The split bag making machine 10 includes a pair of web rolls 2 mounted on an axis 3 in roll stand 4. The web rolls 2 carry respective tubular plastic webs of material 12 which may be clear, colored, or pre-printed as is known in the art. Each web 12 is drawn through a capstan and nip rollers 16, a compensator section 5 formed of a plurality of idler rollers 18, through an idler roller 19, around a secondary split draw roller 20.1, across the synchronization section 6, and through a nip formed between a lower split draw roller 20.2 and upper split draw roller 20.3. A respective belt (or chain) 21 couples each end of the secondary split draw roller 20.1 to a respective end of the lower split draw roller 20.2, via respective pulleys (or sprockets) and each end of the lower split draw roller 20.2 is driven by a respective servo motor 48 and belt 50. Alternatively, each end of the secondary split draw roller 20.1 may be coupled to its respective end of the lower split draw roller 20.2 by gears. Traverse cutting and sealing bars or blades 22 are positioned downstream the lower split draw roller 20.2. The bars 22 are mounted for reciprocation to cut and seal the web 12 after each web index movement to form individual bags. The synchronization section 6 may include optical scanners 14 for scanning marks on the webs 12 (such as eye marks) and hole punch devices 24 for punching holes in the webs 12. A post processing section 7 is located downstream of the synchronizing section 6. Naturally, any known post processing equipment may be used in conjunction with the present invention, including, for example: clamp stackers, pin stackers, or wicketers for bottom seal bags; or air assist, cloth belt, or folders for bottom seal or sideweld bags. Moreover, the present invention is fully independent of the type of post processing equipment which is used, if any.

During operation, the capstan and nip rollers 16 continuously draw the webs 12 from the web rolls 2, and feed the webs to the compensator sections 5. However, for each cycle of the machine (e.g., a 360° rotation of the main drive shaft), the respective draw rollers 20.1, 20.2, 20.3 accelerate for an active portion of the cycle (for example, the first 180° of the cycle), and then remain stationary for an inactive portion of the cycle (for example, the remaining 180° of the cycle).

During each web's inactive portion of the cycle, the hole punching operation is performed, and the web material received from the web roll during the inactive portion of the cycle is absorbed in the compensator section 5. During its active portion of the cycle, each web is moved to the next hole punch position. The optical scanners 14, hole punches 24, and servo motors 48 are coupled, and controlled by, the controller 30. The controller, in turn, may be coupled to and controlled by an operator input device such as keyboard 32 or touch screen.

Prior art twin bag making machines have encountered difficulties in operating effectively at high speeds. For example, as web speed increases, the webs on a twin bag making machine tend to oscillate across their respective lower draw rollers. This oscillation is caused by a number of factors. For example, since the webs are continually accelerating and then stopping for hole punching, sealing, and cutting, the web is continually stretched and then relieved, causing oscillation of the web across the width of the rollers. In addition, because twin bag making machines are wider than single bag making machines, the split rollers in twin bag making machines are wider than the solid rollers of single bag making machines. This increased width causes the split rollers of twin bag making machines to flex or bow under the tension of the webs. This problem is exacerbated by the fact that, since the web width and tension of one web may be different than the web width and tension of the other web, the load applied to one side of the split roller will be different than the load applied to the other side of the split roller. As a result, the problem of web oscillation is much greater in split bag making machines than in single bag making machines. Web oscillation is a significant problem, because in order to maintain consistency in the hole punch operation, the hole punch equipment must be reset each time the web moves.

Moreover, as the web speed increases in high speed operation, the increased tension on the web will cause a decrease in web width. This can be extremely problematic since uniform web width is important in order to have an accurate punching, cutting, or sealing operation. In addition, an increase in web speed causes an increase in web bounce in the synchronization section of the machine. To counteract this bounce, it is known to add more tension to the compensator arms of the compensator section utilizing, for example, a spring, air, or hydraulic tensioning device. This solution, however, disadvantageously results in an increased load to all the drive components.

The above-referenced problems with prior art split bag making machines can be alleviated in accordance with the present invention. One of the causes of the above-referenced problems is that the tension in the web is not uniform. Specifically, since the web is made of plastic, non-uniform tension will distort the shape of the web. In conventional split bag making machines, the webs are fed through the compensator section, around an idler roller, across the synchronizing section, and into the nip formed between the upper and lower split draw rollers. Therefore, the web is being pulled as dead weight across the synchronizing section from the compensator section, thereby contributing to non-uniform web tension and web oscillation.

Figure 2:
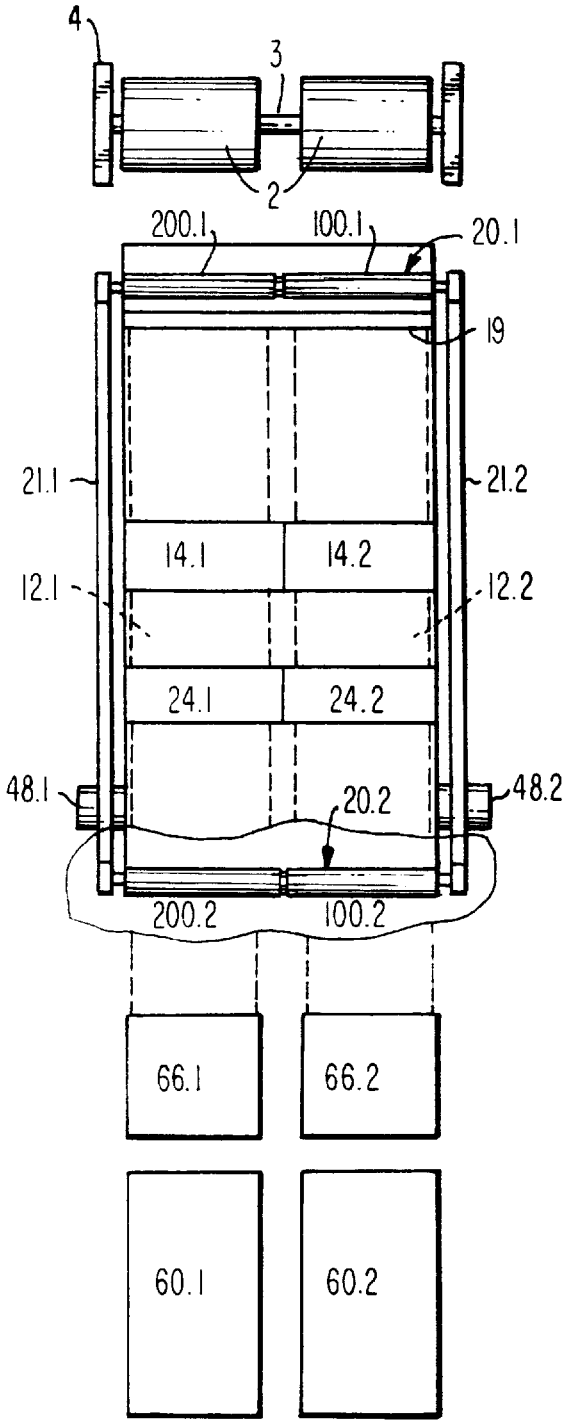
FIG. 2 shows a top view of a portion of the split bag making machine of FIG. 1.

In accordance with the present invention, the secondary split draw roller 20.1 replaces the conventional idler roller of the prior art. In accordance with a first embodiment of the present invention, secondary split draw roller 20.1 includes a first section 100.1 and a second section 200.1. The first and second sections rotate independently from each other and are each coupled to, and driven by, respective first and second sections (100.2, 200.2) of lower primary split draw roller 20.2 via belts (or, for example chains, or gears and the like) 21.1, 21.2 as shown in FIG. 2. As discussed above, the first section 100.1 of lower primary split draw roller 20.2 drives, and forms a nip with, a first section of upper primary split draw roller 20.3, and the second section 200.2 of lower primary split draw roller 20.2 drives, and forms a nip with, a second section of upper primary split draw roller 20.3. The first and second sections of lower primary draw roller 20.2, in turn, are driven by a respective servo-motors 48.1, 48.2.

With this construction, the webs are driven at the same surface speed at both ends of the synchronizing section, maintaining uniform web tension in the processing section despite the changes in web speed which result both from the acceleration of the web during the active cycle of the draw rollers, and from changes in the operating speed of the machine (i.e. bags/min.). As a result, web oscillation is significantly reduced. Moreover, the bag width in the synchronization section will remain essentially constant regardless of web speed. As discussed above, maintaining a uniform web width in the processing section is important because the timing and positioning of the punching, cutting, and sealing operations are predicated on the expected web width. In addition, since the secondary split draw rollers are driven by the primary split draw rollers, when the primary split draw rollers are accelerated by their respective servo motors, the acceleration of the secondary split draw rollers is slightly retarded, thereby preventing slack from developing in the webs.

Figure 3:
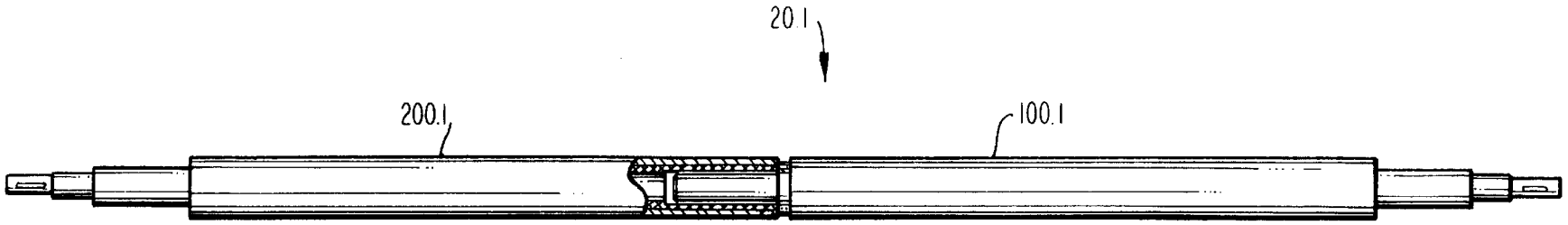
FIG. 3 shows a secondary split draw roller in accordance with an embodiment of the present invention.
Figure 4:
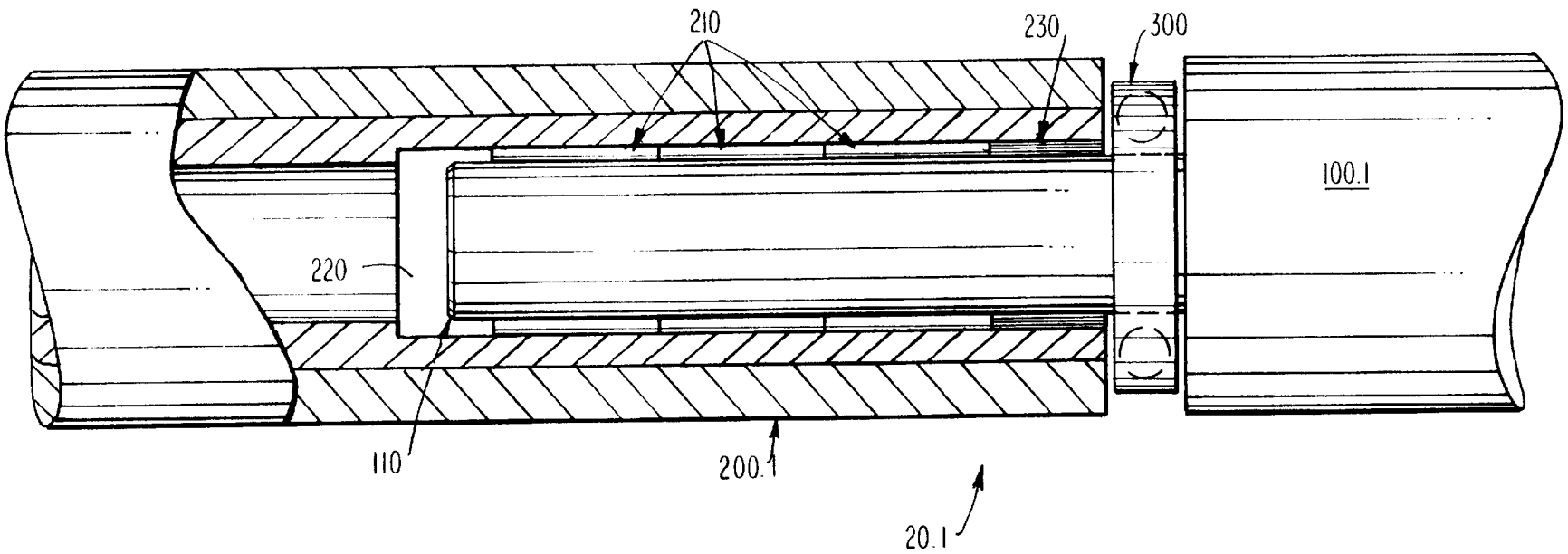
FIG. 4 shows the secondary split draw roller of FIG. 3 in more detail.

FIGS. 3 and 4 illustrate the preferred construction of the secondary split draw roller. First section 100.1 includes a stud 110 and second section 200.1 includes bore 220. Bearing 210 and bushing 230 are mounted within the bore 220 for receiving the stud 110. Center bearing 300 may also be provided for spacing and center support. Preferably, the bearing 210 is a needle bearing, and the bushing 230 is a bronze bushing. The stud 110 rotates freely within the bearing 210 so that the first and second sections 100.1, 200.1 rotate independently of one another.

Figure 5:
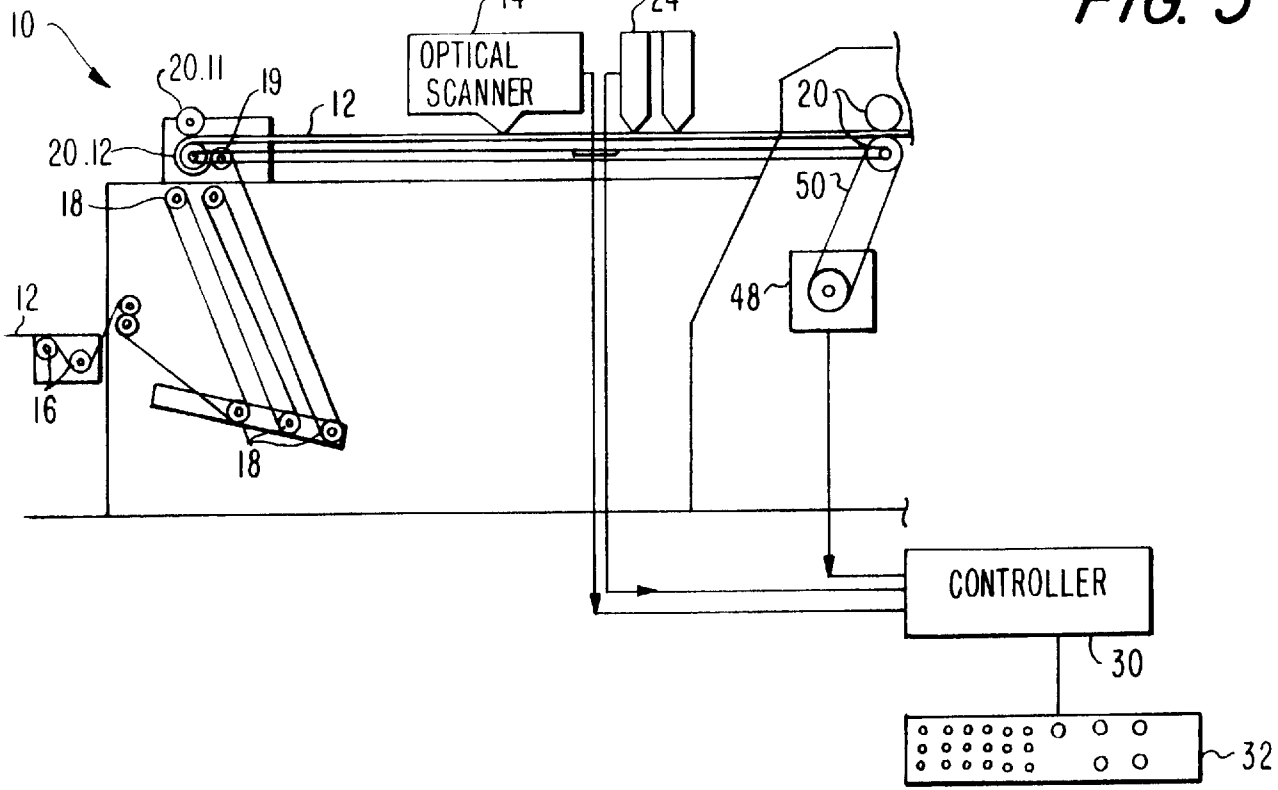
FIG. 5 shows a split bag making machine in accordance with a further embodiment of the present invention.

FIG. 5 shows a split bag making machine in accordance with another aspect of the present invention. In accordance with this embodiment, the secondary split draw roller 20.1 of FIGS. 1 and 2 is replaced with upper and lower secondary split draw rollers 20.11 and 20.12. Upper secondary split draw roller 20.11 is in rolling engagement with lower split draw roller 20.12 such that a nip is formed between the two rollers. In accordance with this construction, additional stability is provided to the web as it passes through the processing section because the nip provides additional draw over the web. The nip can be formed in any known manner. For example, upper secondary split draw roller 20.11 may be driven via contact pressure with lower secondary split draw roller 20.12. Alternatively, the upper and lower secondary split draw rollers 20.11, 20.12 may be geared together. Moreover, while FIG. 5 shows idler roller 19 effectuating a 270° wrap around lower secondary split draw roller 20.12, it is also possible to eliminate idler roller 19 and to pass the web directly from the compensator sections 5 into the upper and lower secondary split draw rollers 20.11, 20.12.

Figure 6:
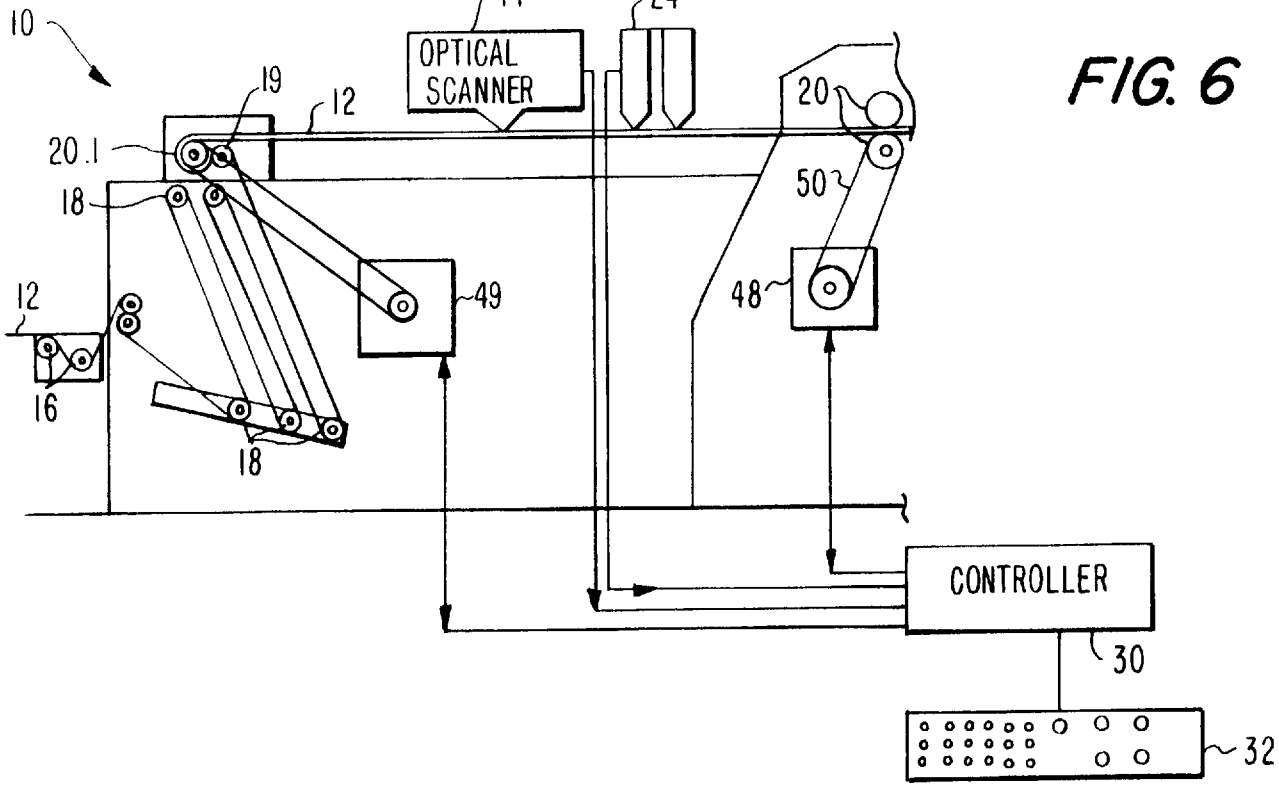
FIG. 6 shows a split bag making machine in accordance with a second embodiment of the present invention.
Figure 7:
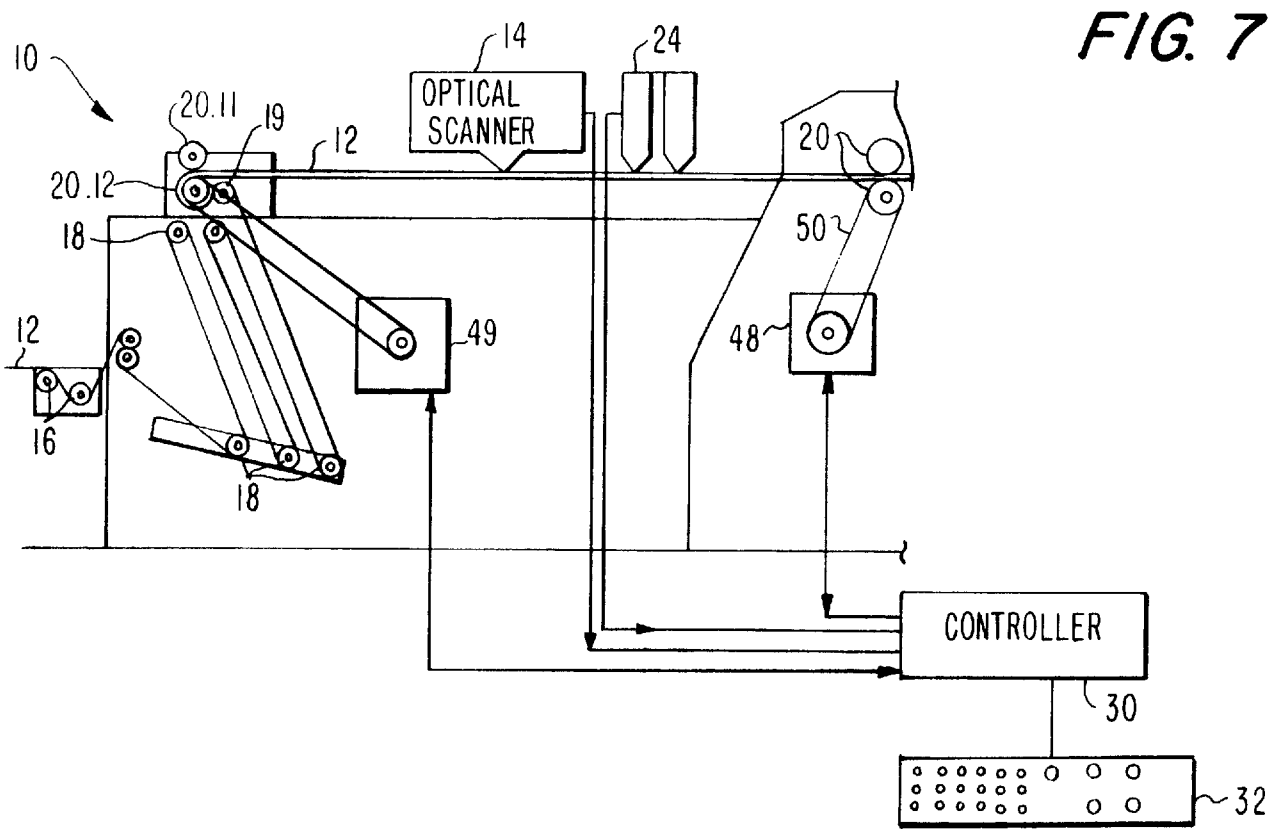
FIG. 7 shows a split bag making machine in accordance with a further embodiment of the present invention.

FIG. 6 shows a split bag making machine in accordance with a second embodiment of the present invention. In accordance with this embodiment, each side of the secondary split draw roller 20.1 is driven by an independent servo motor 49 (only the servo motor on one side of the secondary split draw roller 20.1 is shown) and each of the primary split draw rollers 20.2 is driven by an independent servo motor (48.1, 48.2). Each servo motor 48, 49 is coupled to the controller 30. In accordance with this embodiment, each servo motor 48, 49 is independently controlled to provide additional control over web tension. For example, in high speed operation, it may be desirable to retard the speed of the secondary split draw rollers relative to the primary split draw rollers as the web speed changes in order to increase web tension. In other words, when accelerating from X feet/min. to X+10 feet/min., it may be desirable for the primary split draw rollers to reach a speed of X+Y (Y=0 through 10) at a time T, and for the secondary split rollers to reach the speed of X+Y at time T+Δt, in order to retard the secondary split roller and increase the tension of the web. Similarly, by advancing the speed of the secondary split draw roller relative to the primary split draw roller as the web speed changes, web tension may be decreased. For example, if the operator observes that one of the webs is oscillating, the operator can decrease the speed of the section of the secondary split draw roller on which that web is traveling. Alternatively, if slack is observed in a web, the speed of the section of the secondary split draw roller on which that web is traveling can be decreased to remove the slack. In accordance with a still further embodiment of the present invention, the split bag making machine of FIG. 6 includes upper and lower secondary split draw rollers 20.11 and 20.22 (as shown in FIG. 7) to provide increased draw over the webs.

Figure 8:
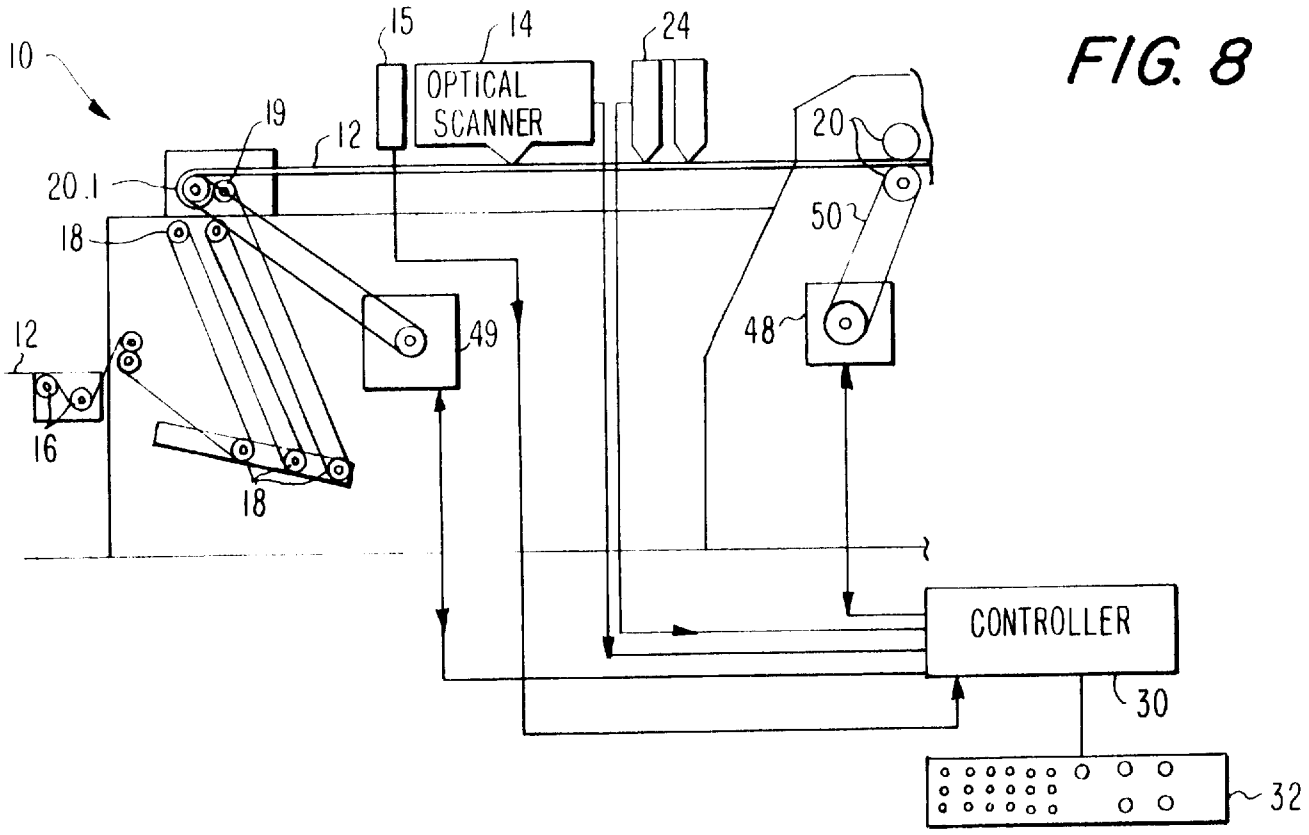
FIG. 8 shows a split bag making machine in accordance with a third embodiment of the present invention.
Figure 9:
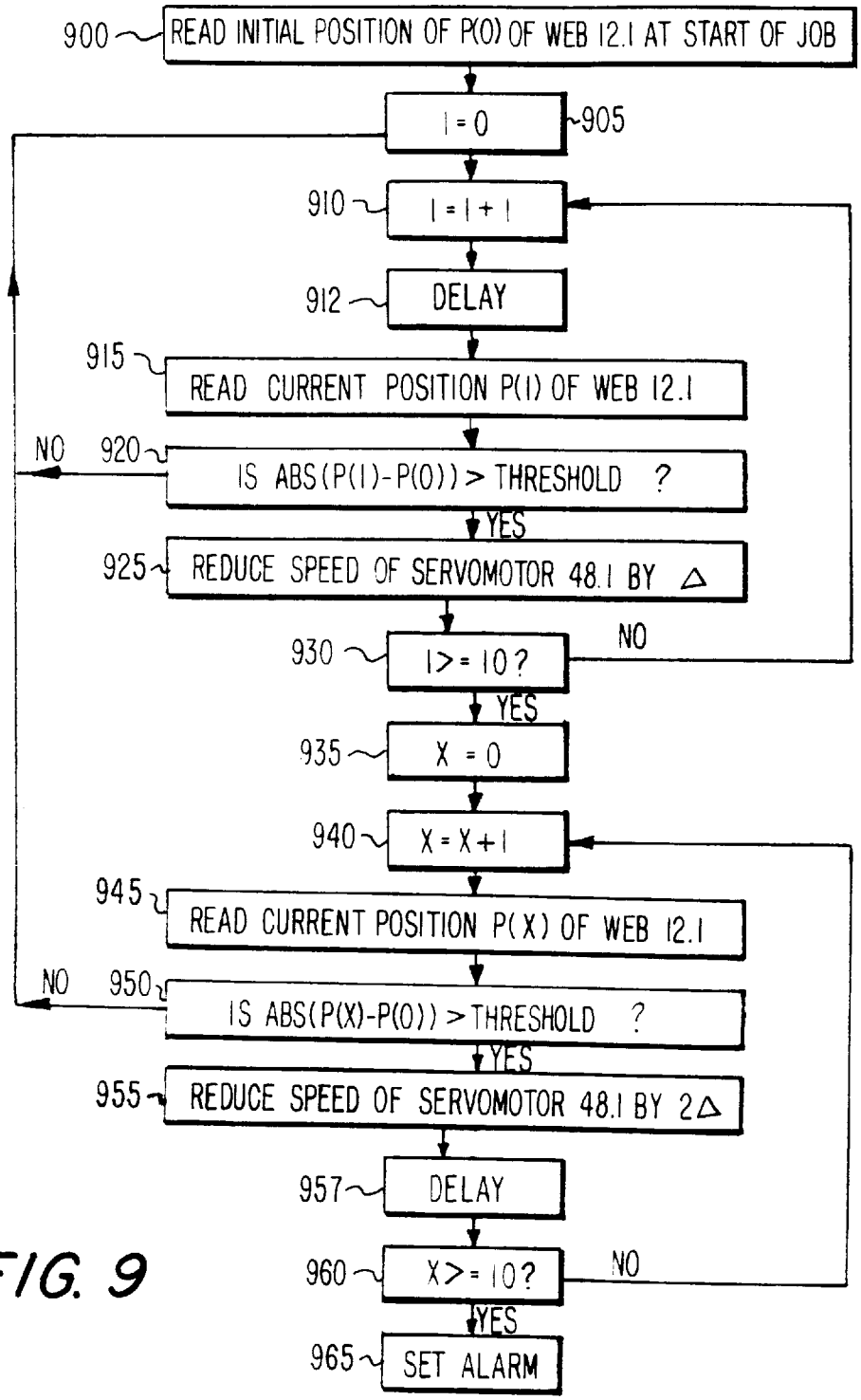
FIG. 9 shows an illustrative flow chart for the third embodiment of the present invention.

FIG. 8 shows a split bag making machine according to a third embodiment of the present invention. In accordance with this embodiment, the split bag making machine as described above with regard to FIG. 6 further includes an optical sensor(s) or scanner(s) 15 to detect the occurrence of web oscillation in webs 12.1, 12.2. The sensor(s) 15 is of known construction, and is coupled to the controller 30. A number of algorithms may be used to detect and control web oscillation. As an illustration, referring to FIG. 9, the initial (or desired) position of web 12.1 is read at the beginning of the job (step 900), and a counter I is reset and incremented (step 905, 910). Then the current position (P(1)) of the web 12.1 is read (step 915) and compared with the initial or desired position P(0). If the difference exceeds a predetermined deviation (step 920), the rotational speed of the servomotor 48.1 is reduced by an increment Δ (step 925) and the counter is incremented (step 910). If the difference is within the predetermined deviation, the counter is reset and incremented (steps 905, 910). After a predetermined delay (step 912), the current position is read again and steps 920 through 930 are repeated. If the counter I reaches 10, and the current web position continues to exceed the deviation (step 930), a second counter X is reset and incremented (step 935, 940). The current position of the web is then read (step 945) and compared with the initial or desired position P(0). If the difference exceeds the predetermined deviation (step 950), the rotational speed of the servomotor 48.1 is reduced by an increment 2Δ (step 955) and, after a predetermined delay (step 957), the second counter is incremented (step 940). The current position is then read again (step 945) and steps 950 through 960 are repeated. If the second counter X reaches 10, and the current web position continues to exceed the threshold (step 960), an alarm is set (step 965) to alert the operator that a problem exists in the system. Naturally, this technique may also be used to detect and control web oscillation in web 12.2.

Figure 10:
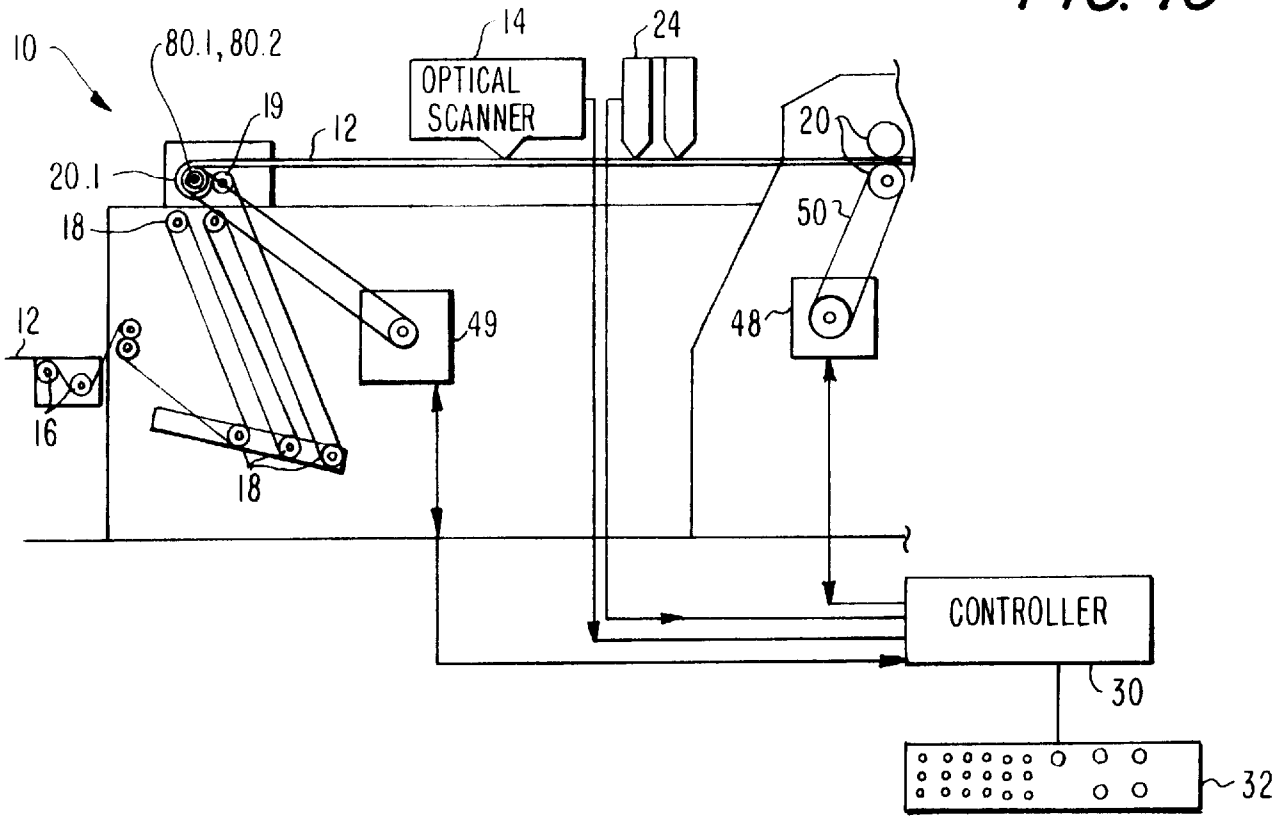
FIG. 10 shows a split bag making machine in accordance with a fourth embodiment of the present invention.
Figure 11:
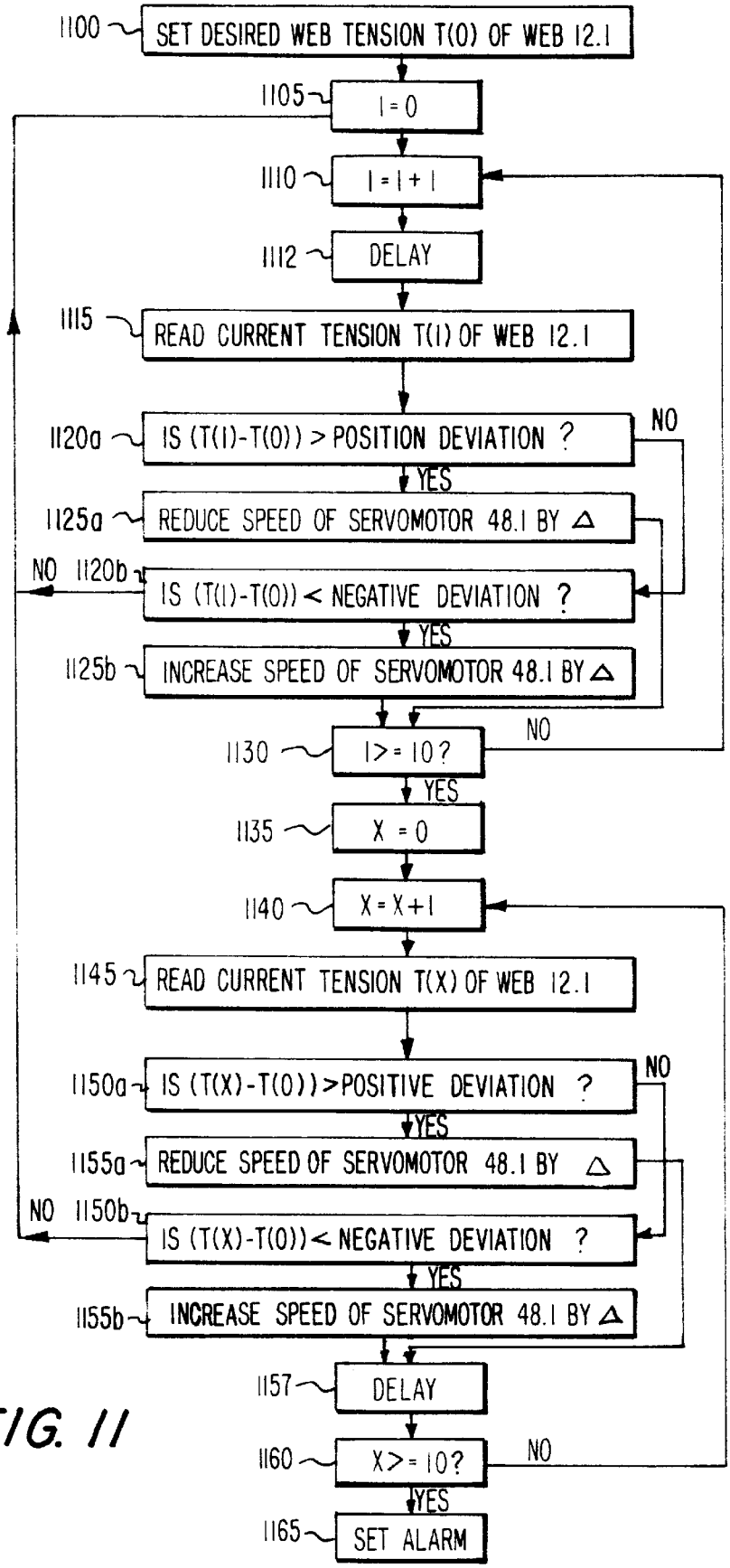
FIG. 11 shows an illustrative flow chart for the fourth embodiment of the present invention.

FIG. 10 shows a split bag making machine according to a third embodiment of the present invention. In accordance with this embodiment, the split bag making machine as described above with regard to FIG. 6 and/or FIG. 8 further includes a web tension sensor. While a variety of sensors may be employed, the web tension sensor preferably includes respective transducers 80.1, 80.2 located within first and second sections of the secondary split draw roller 20.1 to measure tension in the webs (FIG. 10). The transducers 80.1, 80.2 are of known construction, and are coupled to the controller 30. A number of techniques may be used to measure and control web tension. For example, referring to FIG. 11, the desired web tension for web 12.1 is set at the beginning of the job (step 1100), and a counter I is reset and incremented (step 1105, 1110). Then, after a delay (step 1112), the current tension (T(I)) of the web 12.1 is read (step 1115) and compared with the desired tension T(0). If the difference exceeds a predetermined positive deviation or falls below a predetermined negative deviation (steps 1120*a*, *b*), the rotational speed of the servomotor 48.1 is reduced (step 1125*a*) or increased (step 1125*b*) respectively by an increment Δ, and the counter is incremented (step 1110). If the differences are within the predetermined deviations, the counter is reset (steps 1105, 1110). After a predetermined delay (step 1112), the current tension is read again (step 1115) and steps 1120*a*, 1125*a*, 1120*b*, 1125*b* and/or 1130 are repeated. If the counter I reaches 10, and the current web tension continues to fall outside the positive and negative deviations (step 1130), a second counter X is reset and incremented (steps 1135, 1140), and the current tension of the web is read (step 1145) and compared with the initial or desired tension T(0). If the difference exceeds the predetermined positive deviation (step 1150*a*), or falls below the predetermined negative deviation (step 1150*b*), the rotational speed of the servomotor 48.1 is reduced (step 1155*a*) or increased (step 1155*b*), respectively, by an increment Δ and the second counter is incremented (step 1140). After a predetermined delay (step 1157), the current tension is read again and steps 1150*a*, 1155*a*, 1150*b*, 1155*b*, 1157 and/or 1160 repeated. If the second counter X reaches 10, and the current web tension continues to exceed (or fall below) the deviations (step 1160), an alarm is set (step 1165) to alert the operator that a problem exists in the system.

What is claimed is:

1. An apparatus for drawing a pair of webs through a synchronization section of a split bag making machine, comprising:

a first primary split draw roller and a second primary split draw roller, each having first and second web contacting sections which are independently rotatable, the first section of the first primary split draw roller being in rolling engagement with the first section of the second primary split draw roller at a first nip through which a first one of the webs is adapted to pass, the second section of the first primary split draw roller being in rolling engagement with the second section of the second primary split draw roller at a second nip through which a second one of the webs is adapted to pass;

a first secondary split draw roller positioned upstream of the first and second primary split draw rollers and over which the first and second webs are adapted to run, the first secondary split draw roller having a first web contacting section corresponding to the first web contacting sections of the first and second primary split draw rollers and having a second web contacting section corresponding to the second web contacting sections of the first and second primary split draw rollers, the first and second web contacting sections of the first secondary split draw roller being independently rotatable;

a first transmission element coupling the first web contacting section of the first secondary split draw roller to the first web contacting section of the first primary split draw roller, such that rotation of the first web contacting section of the first primary split draw roller causes rotation of the first web contacting section of the first secondary split draw roller;

a first servomotor coupled to the first web contacting section of one of the first primary split draw roller and the first secondary split draw roller;

a second transmission element coupling the second web contacting section of the first secondary split draw roller to the second web contacting section of the first primary split draw roller, such that rotation of the second web contacting section of the first primary split draw roller causes rotation of the second web contacting section of the first secondary split draw roller; and a second servomotor coupled to the second web contacting section of one of the first primary split draw roller and the first secondary split draw roller.

2. The apparatus according to claim 1, wherein the first transmission element is a chain coupled to the first web contacting section of the first primary split draw roller and the first secondary split draw roller via respective sprockets.

3. The apparatus according to claim 1, wherein the first transmission element is a belt coupled to the first web contacting section of the first primary split draw roller and the first secondary split draw roller via respective pulleys.

4. The apparatus according to claim 1, wherein the first servo motor is coupled to the first web contacting section of the first primary split draw roller.

5. The apparatus according to claim 1, further including a second secondary split draw roller having a first web contacting and a second web contacting section which are independently rotatable, the first section of the first secondary split draw roller being in rolling engagement with the first section of the second secondary split draw roller at a third nip, the second section of the first secondary split draw roller being in rolling engagement with the second of the second secondary split draw roller at a fourth nip.

6. The apparatus according to claim 1, wherein the first secondary split draw roller is arranged relative to the first and second primary split draw rollers such that the length of a path of the first and second webs between the first secondary split draw roller and the respective first or second nip is substantially invariable.

7. The apparatus according to claim 1, wherein the first secondary split draw roller is arranged relative to the first and second primary split draw rollers such that a path of the first and second webs between the first secondary split draw roller and the respective first or second nip is substantially straight.

8. The apparatus according to claim 1, wherein the first web contacting section of the first secondary split draw roller comprises an axially projecting stud and the second web contact section of the first secondary split draw roller comprises a bore receivable of the stud, the first secondary split draw roller further comprising bearing means interposed between the stud and a surface defining the bore.

9. The apparatus according to claim 1, wherein the first transmission element is structured and arranged that the surface speed of the first web over the first web contacting section of the first primary draw roller is substantially the same as the surface speed of the first web over the first web contacting section of the first secondary split draw roller, the second transmission element being structured and arranged such that the surface speed of the second web over the second web contacting section of the first primary split draw roller is substantially the same as the surface speed of the second web over the second web contacting section of the first secondary split draw roller.

10. An apparatus for drawing a pair of webs through a synchronization section of a split bag making machine, comprising:

a first primary split draw roller and a second primary split draw roller, each having first and second web contacting sections which are independently rotatable, the first section of the first primary split draw roller being in rolling engagement with the first section of the second primary split draw roller at a first nip through which a first one of the webs is adapted to pass, the second section of the first primary split draw roller being in rolling engagement with the second section of the second primary split draw roller at a second nip through which a second one of the webs is adapted to pass;

a first secondary split draw roller positioned upstream of the first and second primary split draw rollers and over which the first and second webs are adapted to run, the first secondary split draw roller having a first web contacting section corresponding to the first web contacting sections of the first and second primary split draw rollers and having a second web contacting section corresponding to the second web contacting sections of the first and second primary split draw rollers, the first and second web contacting sections of the first secondary split draw roller being independently rotatable;

a first servomotor coupled to the first web contacting section of the first primary split draw roller;

a second servomotor coupled to the second web contacting section of the first primary split draw roller;

a third servomotor coupled to the first web contacting section of the first secondary split draw roller;

a fourth servomotor coupled to the second web contacting section of the first secondary split draw roller; and a controller to the first, second, third, and fourth servomotor and being structured and arranged to control the first, second, third and fourth servomotor such that the surface speed of the first and second webs about the respective web contacting section of first primary split draw roller and through the respective nip are substantially equal.

11. The apparatus according to claim 10, further including a second secondary split draw roller having a first web contacting section and a second web contacting section which are independently rotatable, the first section of the first secondary split draw roller being in rolling engagement with the first section of the second secondary split draw roller at a third nip, the second section of the first secondary split draw roller being in rolling engagement with the second section of the second secondary split draw roller at a fourth nip.

12. The apparatus according to claim 10, further including:

a sensor for periodically detecting a position of the first web traversing the synchronization section of the split bag making machine and transmitting information indicative of the position to the controller;

the controller receiving the information, and, upon detecting an occurrence of web oscillation, being structured and arranged to decrease a speed of the third servo motor.

13. The apparatus according to claim 12, wherein the controller detects the occurrence of web oscillation as a function of a current web position and a desired web position.

14. The apparatus according to claim 10, further including:

a sensor for periodically measuring tension of the first web traversing the synchronization section of the split bag machine and transmitting information indicative of the tension to the controller;

the controller receiving the information, and being structured and arranged to control the speed of the third servo motor as a function of the received information.

15. The apparatus to claim 14, wherein the controller controls the speed of the third servomotor as a function of a current web tension and a desired web tension.

16. The apparatus to claim 15, wherein the sensor is a transducer coupled to the first web contacting section of the first secondary split draw roller.

17. The apparatus according to claim 16, wherein the transducer is mounted within the first web contacting section of the first secondary split draw roller.

18. The apparatus according to claim 10, further including:

a sensor for periodically measuring tension of the first web traversing the synchronization section of the split bag machine and transmitting information indicative of the tension to the controller;

the controller receiving the information, and being structured and arranged to control the speed of at least one of the first and the third servo motors as a function of the received information.

19. The apparatus according to claim 18, wherein the controller is structured and arranged to control the speed of at least one of the first and the third servomotor as a function of a current web tension and a desired web tension.

20. The apparatus according to claim 10, further including:

a sensor for periodically detecting a position of at least one of the first and second webs traversing the synchronization section of the split bag machine and transmitting information indicative of the position to the controller;

the controller receiving the information, and, upon detecting an occurrence of web oscillation, being structured ad arranged to adjust a speed of at least one of the first and the third servo motors.

21. The apparatus according to claim 10, wherein the first secondary split draw roller is arranged relative to the first and second primary split draw rollers such that the length of a path of the first and second webs between the first secondary split draw roller and the respective first or second nip is substantially invariable.

22. The apparatus according to claim 10, wherein the first secondary split draw roller is arranged relative to the first and second primary split draw rollers such that a path of the first and second webs between the first secondary split draw roller and the respective first or second nip is substantially straight.

23. The apparatus according to claim 10, wherein the first web contacting section of the first secondary split draw roller comprises an axially projecting stud and the second web contact section of the first secondary split draw roller comprises a bore receivable of the stud, the first secondary split draw roller further comprising bearing means interposed between the stud and a surface defining the bore.

24. An apparatus for drawing a pair of webs through a synchronization section of a bag making machine, comprising:

a first primary split draw roller and a second primary split draw roller, each having first and second web contacting sections which are independently rotatable, the first web contacting section of the first primary split draw roller being in rolling engagement with the first web contacting section of the second primary split draw roller at a first nip through which a first one of the webs is adapted to pass, the second web contacting section of the first primary split draw roller being in rolling engagement with the second web contacting section of the second primary split draw roller at a second nip through which a second one of the webs is adapted to pass;

a first secondary split draw roller positioned upstream of the first and second primary split draw rollers and over which the first and second webs are adapted to run, the first secondary split draw roller having a first web contacting section corresponding to the first web contacting sections of the first and second primary split draw rollers and having a second web contacting section corresponding to the second web contacting sections of the first and second primary split draw rollers, the first and second web contacting sections of the first secondary split draw roller being independently rotatable;

a first servomotor coupled to the first web contacting section of one of the first primary split draw roller and the first secondary split draw roller;

a first transmission element coupling the first web contacting section of the first primary split draw roller to the first web contacting section of the first secondary split draw roller;

a second servomotor coupled to the second web contacting section of one of the first primary split draw roller and the secondary split draw roller;

a second transmission element coupling the second web contacting section of the first primary split draw roller to the second web contacting section of the first secondary split draw roller; and a controller coupled to the first and second servomotor and being structured and arranged to control the first and second servomotors such that the surface speed of the first web over the first secondary split draw roller and through the first and second nips are substantially equal.

25. The apparatus according to claim 24, further including a second secondary split draw roller having a first web contacting section and a second web contacting section which are independently rotatable, the first web contacting section of the first secondary split draw roller being in rolling engagement with the first web contacting section of the second secondary split draw roller at a third nip through which the first web is adapted to pass, the second web contacting section of the first secondary split draw roller being in rolling engagement with the second web contacting section of the second secondary split draw roller at a fourth nip through which the second web is adapted to pass.

26. The apparatus according to claim 24, further including:

a sensor for periodically detecting a position of the first web traversing the synchronization section of the bag making machine and transmitting information indicative of the position to the controller;

the controller receiving the information, and, upon detecting an occurrence of web oscillation, being structured and arranged to decrease a speed of the first servomotor.

27. The apparatus according to claim 24, further including:

a sensor for periodically measuring tension of the first web traversing the synchronization second of the bag machine and transmitting information indicative of the tension to the controller;

the controller receiving the information, and being structured and arranged to control the speed of the first servomotor as a function of the received information.

28. The apparatus according to claim 27, wherein the sensor is a transducer coupled to the first web contacting of the first secondary split draw roller.

29. The apparatus according to claim 28, wherein the transducer is mounted within the first secondary split draw roller.

30. The apparatus according to claim 27, wherein in controller is structured and arranged to control the speed of the first servomotor as a function of a current web tension and a desired web tension.

31. The apparatus according to claim 24, further including:

a sensor for periodically measuring a tension of the first web traversing the synchronization section of the bag machine and transmitting information indicative of the tension to the controller;

the controller receiving the information, and being structured and arranged to control the speed of the first servomotor as a function of the received information.

32. The apparatus according to claim 31, wherein the controller is structured and arranged to control the speed of the first servomotor as a function of current web tension and a desired web tension.

33. The apparatus according to claim 24, further including:

a sensor for periodically detecting a position of the first web traversing the synchronization section of the bag machine and transmitting information indicative of the position to the controller;

the controller receiving the information, and, upon detecting an occurrence of web oscillation, being structured and arranged to adjust a speed of the first servomotor.

34. The apparatus according to claim 24, wherein the first secondary split draw roller is arranged relative to the first and second primary split draw rollers such that the length of a path of the first and second webs between the first secondary split draw roller and the respective one of the first and second nips is substantially invariable.

35. The apparatus according to claim 24, wherein the first secondary split draw roller is arranged relative to the first and second primary split draw rollers such that a path of the first and second webs between the first secondary split draw roller and the respective one of the first and second nips is substantially straight.

* * * * *